US006886270B2

(12) United States Patent
Gilmer

(10) Patent No.: US 6,886,270 B2
(45) Date of Patent: May 3, 2005

(54) GOLF CART FAN

(76) Inventor: Diane L. Gilmer, 128 Pacer Cir., Wellington, FL (US) 33414-4051

( * ) Notice: Subject to any disclaimer, the term of this patent is extended or adjusted under 35 U.S.C. 154(b) by 0 days.

(21) Appl. No.: 10/292,522

(22) Filed: Nov. 13, 2002

(65) Prior Publication Data

US 2004/0088877 A1 May 13, 2004

(51) Int. Cl.[7] ..... F26B 19/00
(52) U.S. Cl. ..... 34/90; 34/239; 180/53.1
(58) Field of Search ..... 34/90, 239, 96; 180/53.1

(56) References Cited

U.S. PATENT DOCUMENTS 4,850,804 A * 7/1989 Huang ..... 416/246
5,397,268 A * 3/1995 Chang et al. ..... 454/338
5,547,343 A * 8/1996 Jane et al. ..... 416/246
5,725,356 A * 3/1998 Carter ..... 416/240
5,772,468 A 6/1998 Kowalski et al.
5,820,407 A 10/1998 Morse et al.
5,940,980 A * 8/1999 Lee et al. ..... 34/97
6,062,915 A 5/2000 Costello et al.
6,109,874 A 8/2000 Steiner et al.
6,158,140 A 12/2000 Orr
6,179,564 B1 1/2001 Park
6,325,362 B1 12/2001 Massey et al.
6,422,030 B1 * 7/2002 Calvert ..... 62/314
6,435,293 B1 8/2002 Williams

* cited by examiner

*Primary Examiner*—Denise L. Esquivel
*Assistant Examiner*—Kathryn S. O'Malley
(74) *Attorney, Agent, or Firm*—Richard C. Litman

(57) ABSTRACT

A small, portable fan having a spring-biased clamp at the base thereof. The clamp is adapted to mount to almost any surface on a conventional golf cart. The fan is provided with power cords having alligator clips at the ends thereof. The power cords can readily be connected to the battery of the golf cart, which battery is normally positioned under the seat of the cart. The fan can be mounted to and dismounted from the golf cart with ease.

1 Claim, 3 Drawing Sheets

GOLF CART FAN

BACKGROUND OF THE INVENTION

1. Field of the Invention

The present invention generally relates to recreational equipment. More specifically, the present invention is drawn to a portable fan adapted to be mounted on a golf cart.

2. Description of the Related Art

Golf is often played in hot, sweltering weather where a refreshing gust of air is almost as welcome as three birdies and an eagle on the back nine. Many golfers carry small, portable, battery-operated fans to gain relief from the uncomfortable weather conditions. Unfortunately, the portable fans must be retrieved from the golf bag before each use and replaced in the bag after use. If the fan is deposited on the floor or seat of a golf cart it is subject to damage if sat or stepped on. Further, the user must remember to change the batteries at regular intervals to ensure that the fan will not stop on the hottest day of the year.

It would certainly be a welcome addition to the art to have a portable fan which could be quickly and easily mounted to a golf cart and also be powered by the cart's battery.

There have been many attempts to cool the environs of golf carts or like vehicles. For example, U.S. Pat. No. 6,435,293 B1 (Williams) shows a cart, with a battery powered air conditioner. The cart of the instant patent must be sealed for cooling which would entail a costly expense.

U.S. Pat. No. 6,325,362 B1 (Massey et al.) discloses an open golf cart equipped with a cooling and misting apparatus. Again, the nozzles, pump, heat exchanger, etc. required for this system would be relatively expensive and require a fair amount of maintenance.

U.S. Pat. No. 6,158,140 (Orr) is drawn to a golf cart fan which can be adjusted to various positions. The fan is adapted to be permanently supported from a golf cart having a dashboard.

U.S. Pat. No. 6,109,874 (Steiner et al.) and U.S. Pat. No. 6,179,564 B1 (Park) show portable, battery-operated fans, which fans are of the same genre as the portable fans discussed above.

U.S. Pat. No. 5,772,468 (Kowalski et al.), U.S. Pat. No. 5,820,407 (Morse et al.) and U.S. Pat. No. 6,062,915 (Costello et al.) disclose various types of battery clamps.

None of the above inventions and patents, taken either singularly or in combination, is seen to disclose a portable fan for a golf cart as will subsequently be described and claimed in the instant invention.

SUMMARY OF THE INVENTION

The present invention comprises a small, portable fan having a spring-biased clamp at the base thereof. The clamp is adapted to mount to almost any surface on a conventional golf cart. The fan is provided with power cords having alligator clips at the ends thereof. The power cords can readily be connected to the battery of the golf cart, which battery is normally positioned under the seat of the cart. The fan can be mounted to and dismounted from the golf cart with ease. A source of power is always available since power is obtained from the golf cart's battery.

Accordingly, it is a principal object of the invention to provide a portable fan for use with a golf cart or the like.

It is another object of the invention to provide a portable fan, which fan can be quickly an easily mounted to and dismounted from a conventional golf cart.

It is a further object of the invention to provide a portable fan for a golf cart, which fan relies on electric power for operation thereof.

Still another object of the invention is to provide a portable fan for a golf cart, which fan is equipped with power cords for easy connection to the golf cart's battery.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
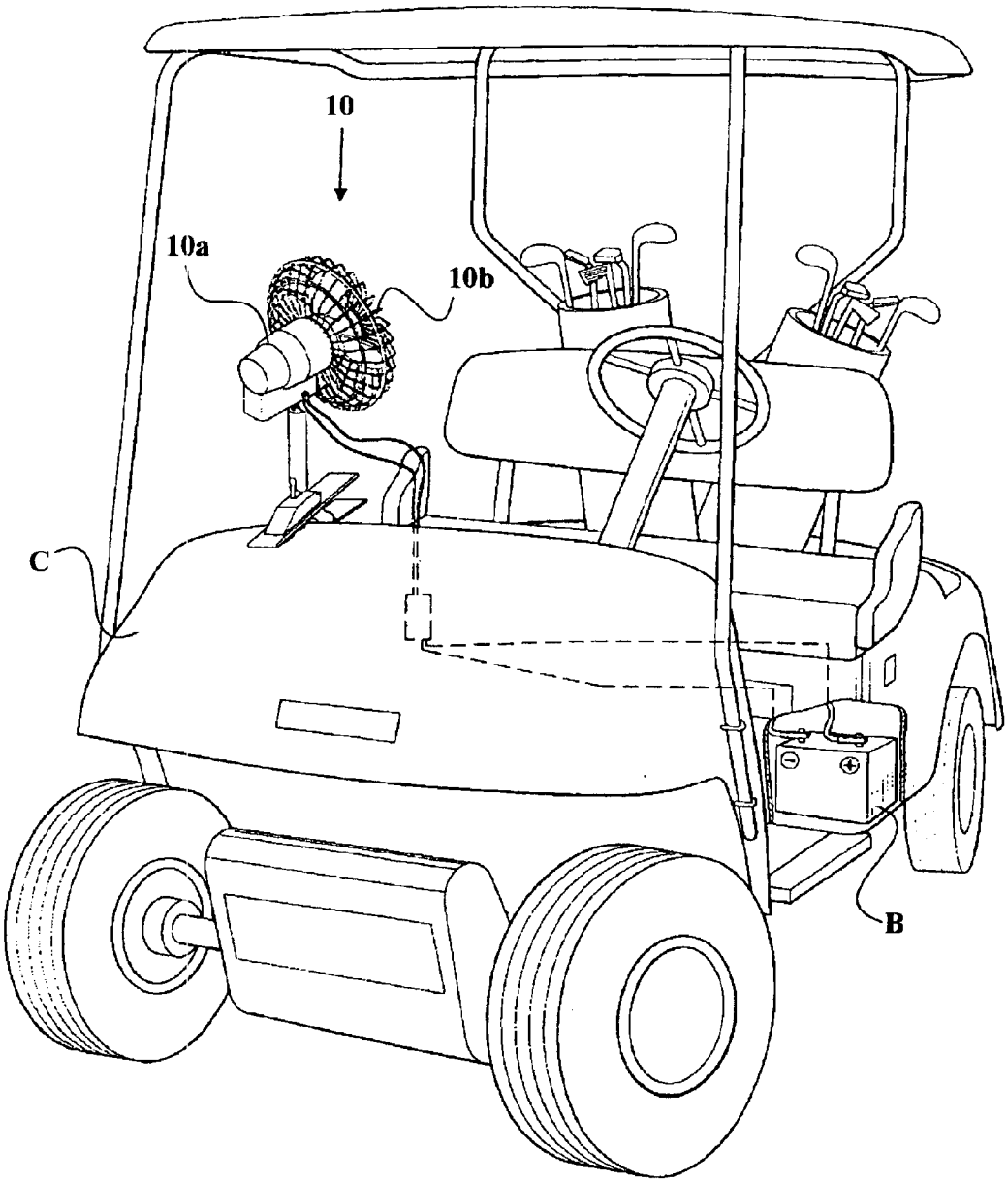
FIG. 1 is an environmental, perspective view of a fan and golf cart according to the present invention.
Figure 2:
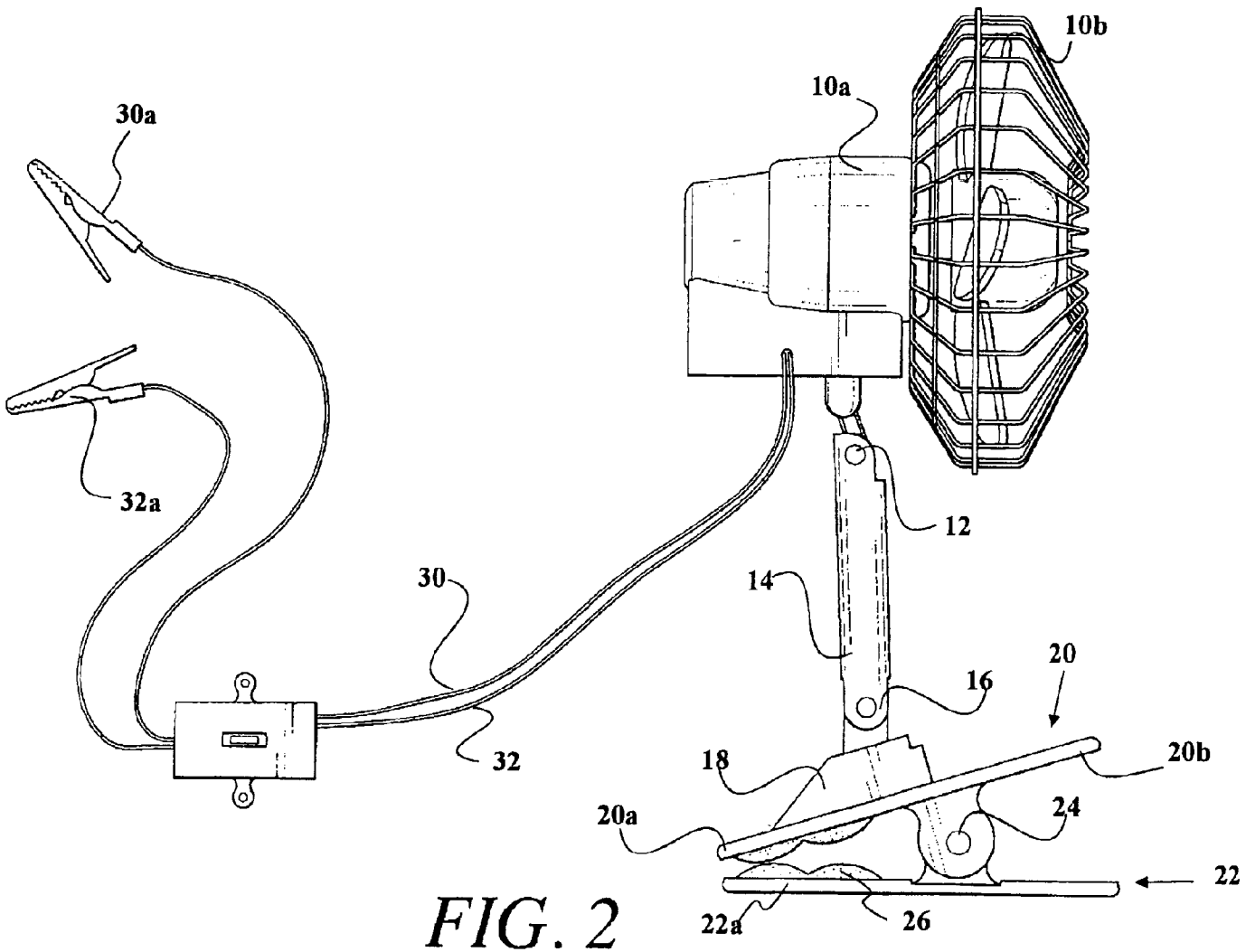
FIG. 2 is a plan view of a golf cart fan according to the present invention.

The golf cart fan of the present invention is generally indicated at 10 as illustrated in FIGS. 1 and 2. Fan 10 includes a motor housing 10*a* connected to conventional fan blades 10*b*. Fan 10 is shown mounted to the dash area of a conventional golf cart C. Although a golf cart is shown and contemplated, it should be noted that the fan could function on almost any type open-air vehicle having a battery power source. It should also be noted that the fan could be of the well known oscillating type if desired.

As best seen in FIG. 2, fan 10 is pivotally mounted at 12 to the proximate end of an elongate shaft 14. In turn, shaft 14 is pivotally mounted at its distal end 16 to a mounting clamp 18. Mounting clamp 18 includes a pair of clamp members 20, 22 each having jaw portions 20*a*, 22*a* and handle portions 20*b*. Clamp members 20, 22 are pivotally connected at 24. A conventional torsion spring (not shown) is utilized to bias jaw portions 20*a*, 22*a* toward each other. Soft padding 26 is provided on the jaws to prevent damage to the surfaces of the golf cart.

Figure 3:
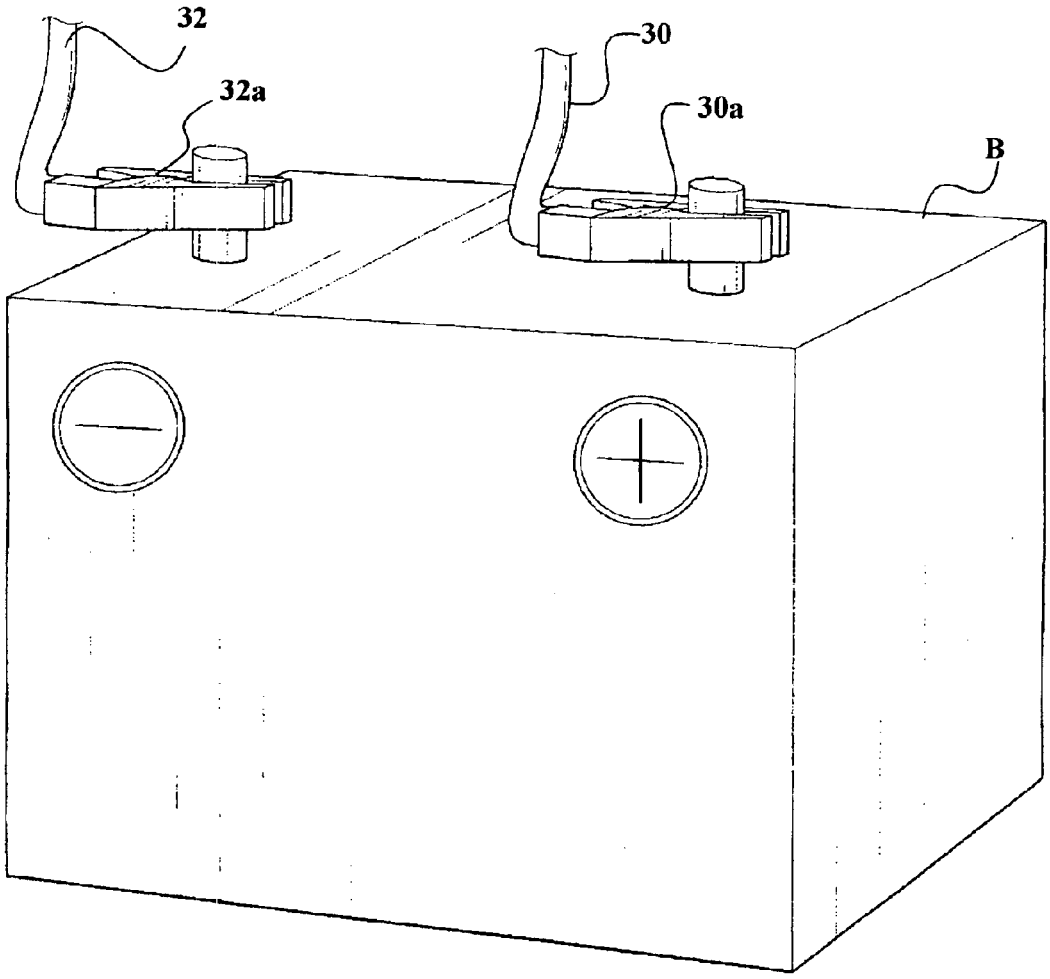
FIG. 3 is a partial view showing the power cords of the fan connected to the golf cart's battery.

Power cords 30, 32 extend from te fan's motor housing and terminate in metallic alligator clips 30*a*, 32*a*. Although alligator clips are preferred, it is obvious that any conventional spring-like clamping device could be utilized. As best seen in FIG. 3, clips 30*a*, 32*a* are connected to the terminals of the golf cart's battery B. A convenient on/off switch is provided to selectively provide power to the fan. The switch could also incorporate high and low settings.

This arrangement allows a golfer to have access to a cooling fan which is readily mounted to almost any conventional golf cart. The mounted fan will not be in the way and may be operated when needed.

It is to be understood that the present invention is not limited to the embodiment described above, but encompasses any and all embodiments within the scope of the following claims.

I claim:

1. A combination of a golf cart and a fan, said golf cart having a seat and a battery disposed beneath the seat, comprising:

an elongate, rigid shaft, said shaft having a proximate end and a distal end;

a fan motor housing and fan blades therefor, said fan motor housing having a pivotal connection to said proximate end of said elongate shaft;

amounting clamp mounted to said golf cart, said mounting clamp having a pivotal connection to the distal end of said elongate shaft, wherein said mounting clamp includes;

a pair of clamp members;

a jaw portion defined on each of said pair of clamp members;

a handle portion defined on each of said pair of clamp members and soft padding disposed on said jaw portion defined on each said pair of clamp members;

a pair of power cords, said power cords having first and second ends;

said first ends of said power cords connected to and extending from said motor housing;

a pair of alligator clips, said pair of alligator clips defining said second ends of said power cords and connected to said battery.

* * * * *